US006217484B1

(12) United States Patent
Harshman et al.

(10) Patent No.: US 6,217,484 B1
(45) Date of Patent: Apr. 17, 2001

(54) REHABILITATION APPARATUS

(76) Inventors: Edward J. Harshman, P.O. Box 137, Chattanooga, TN (US) 37405; Gary L. Ingram, 6491 Hideaway Rd., Ooltewah, TN (US) 37363

( * ) Notice: Subject to any disclaimer, the term of this patent is extended or adjusted under 35 U.S.C. 154(b) by 0 days.

(21) Appl. No.: 09/227,074

(22) Filed: Jan. 5, 1999

(51) Int. Cl.[7] ..... A63B 22/00

(52) U.S. Cl. ..... 482/51; 482/35; 482/79; 601/29; 601/34; 434/255

(58) Field of Search ..... 482/35, 39, 41, 482/42, 40, 51, 52, 70, 75, 79, 148, 908; 601/23, 27, 28, 29, 31, 32, 33, 34, 35; 434/251, 255, 258, 260, 261

(56) References Cited

U.S. PATENT DOCUMENTS 3,747,233 * 7/1973 Berryman ..... 434/255
5,520,596 * 5/1996 Johnston ..... 482/52
5,575,739 * 11/1996 Piaget et al. ..... 482/51
5,586,958 * 12/1996 Little, Sr. ..... 482/79
6,077,202 * 6/2000 Gray ..... 482/57

* cited by examiner

*Primary Examiner*—Jerome W. Donnelly
*Assistant Examiner*—Tam Nguyen
(74) *Attorney, Agent, or Firm*—Alan Ruderman; Miller & Martin LLP

(57) ABSTRACT

Apparatus for use in rehabilitation of a patient with a weight bearing restriction on one or both legs includes a pair of vertically movable horizontally elongated platforms and a pair of corresponding vertically fixed platforms. The movable platforms are connected to a mechanism which applies an upwardly directed preselected force so that as the patient walks with a foot on the movable platform, the movable platform will descend if the patient places a greater weight corresponding to the preselected force. A patient may walk with both feet on movable platforms in which case the weights may be selected for each platform or the patient may walk with one foot on the movable platform and one foot on a fixed platform. The platforms move in a vertical plane arcuately in one embodiment and in a vertical plane linearly in a second embodiment. The weights may be moved relatively to the pivot point and, in addition, the movable platform may be locked in its upward position in this latter embodiment.

22 Claims, 5 Drawing Sheets

REHABILITATION APPARATUS

BACKGROUND OF THE INVENTION

This invention relates to apparatus for aiding in the rehabilitation of patients with weight bearing restrictions on one or both legs and more particularly to apparatus including a pair of raised platforms, one of which is stable and the other vertically movable in response to a downward force applied on the upper surface.

In the rehabilitation of patients having weight bearing restrictions on one or both legs, the apparatus conventionally used is the parallel bar structure having a fixed platform on which the patient may walk. The problem with this is that if, for example, there is a maximum tolerable load that should be placed on a leg currently there is no way by which the patient, the therapist or doctor can control the load and further injury may occur. Thus, very conservative therapy may result and this could prolong the rehabilitation process. In some cases, a leg weight exercising machine of the type wherein the patient sits and pushes his or her feet on pedals connected to weights by cables may be used. However, such apparatus is not completely effective since it does not promote the natural gait or stride of the patient. A search of the prior art did not locate anything believed to be relevant, the most relevant reference being U.S. Pat. No. 5,112,045 which shows a platform mounted on a pivot permitting walking motion or balancing by the user for purposes of kinesthetic diagnosis and rehabilitation.

SUMMARY OF THE INVENTION

Consequently, it is a primary object of the present invention to provide apparatus for aiding in the rehabilitation of patients having weight bearing restrictions on one or both legs.

It is another object of the present invention to provide apparatus including at least a pair of raised platforms on which a patient undergoing rehabilitation may walk, one foot being on each platform, at least one of the platforms being movable vertically and having a selected force applied upwardly.

It is a further object of the present invention to provide apparatus for aiding in the rehabilitation of patients with weight bearing restrictions on either one or both legs, the apparatus including two pairs of elongated horizontal movable platforms, one platform of each pair being mounted for movement in a vertical plane, each movable platform being pushed upwardly by selected predetermined force and being pushed in a downward direction by a foot of the patient as the patient strides on either both movable platforms or one of the movable platforms and a fixed platform adjacent to each movable platform.

Accordingly, the present invention provides apparatus for use in rehabilitation of a patient with weight bearing restrictions on one or both legs, the apparatus including a first vertically movable horizontally elongated platform and a second platform which may be either vertically movable or fixed, the movable platform being connected to a mechanism which applies an upwardly directed preselected force thereto and as the patient walks with one foot on the movable platform and the other foot on either a similarly movable platform or a stable platform, the movable platform will descend if the patient places too great a weight load on the platform.

Preferably there are two side-by-side movable platforms and a fixed platform on the other side of each movable platform so that patients having weakness in either both legs or only one leg may walk in either direction. If both legs are involved in the rehabilitation then both movable platforms have individually preselected upward forces applied thereto.

The apparatus further includes conventional parallel bar handrails, there being one handrail associated with each pair of platforms preferably supported by the fixed platforms where such fixed platforms are utilized.

The mechanism which mounts each movable platform provides a fulcrum about which the platform may move, a weight being placed on one side of the fulcrum and the platform and thus the foot of the patient being on the other side. Preferably, the weight may be moved relatively to the fulcrum.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
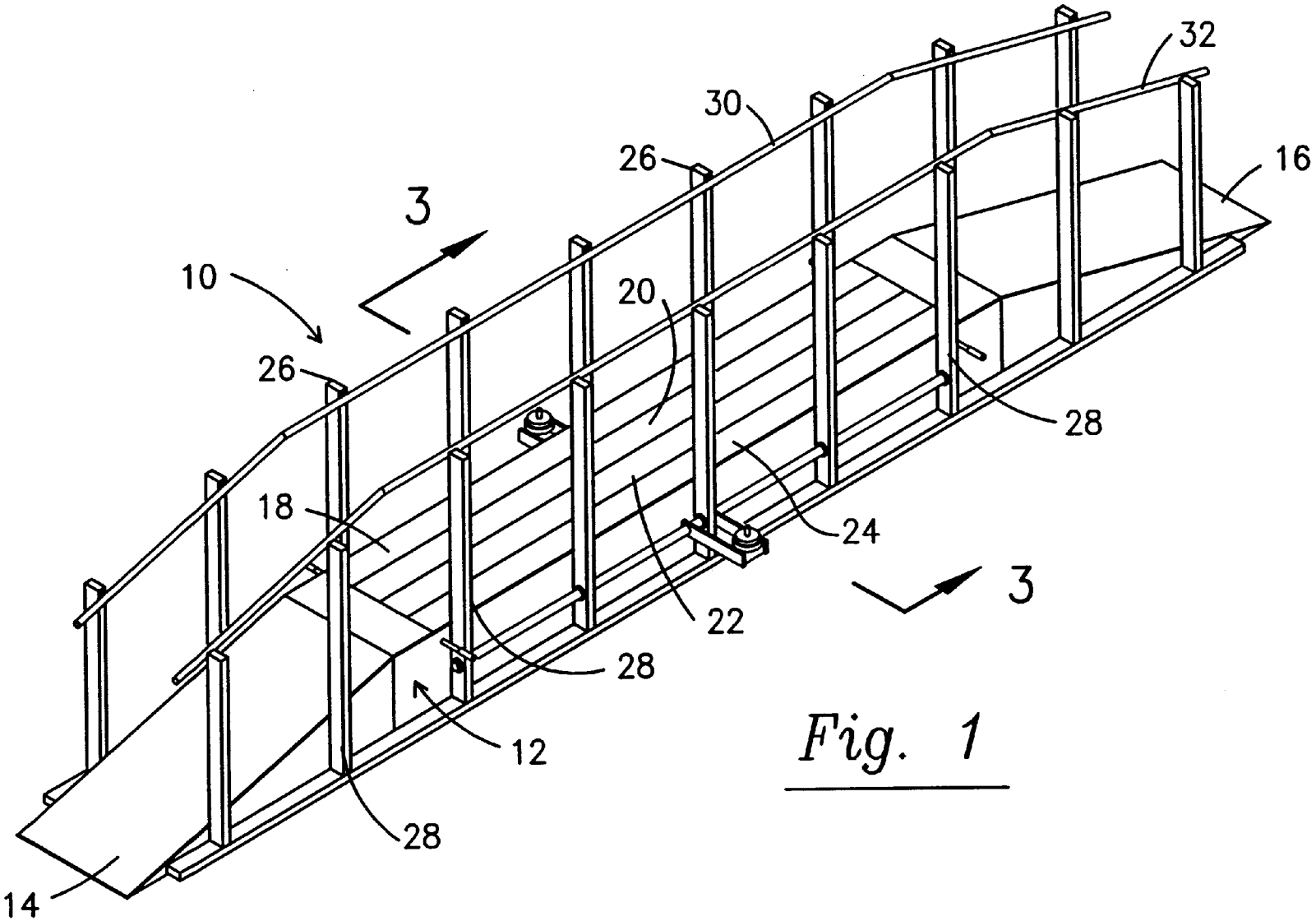
FIG. 1 is a perspective view illustrating rehabilitation apparatus constructed in accordance with the principles of the present invention.

Referring to the drawings, FIG. 1 illustrates rehabilitation apparatus 10 in the form of a walkway 12 constructed using principles of the present invention. The walkway comprises first and second fixed ramps 14, 16 at respective ends thereof, the major portion of the ramps being inclined, and having a plurality of platforms preferably two pair of two platforms each such that there may be four platforms extending longitudinally therebetween. As will be understood, a rehabilitation apparatus incorporating only one pair of platforms may be constructed without departing from the principles of the present invention.

Figure 2:
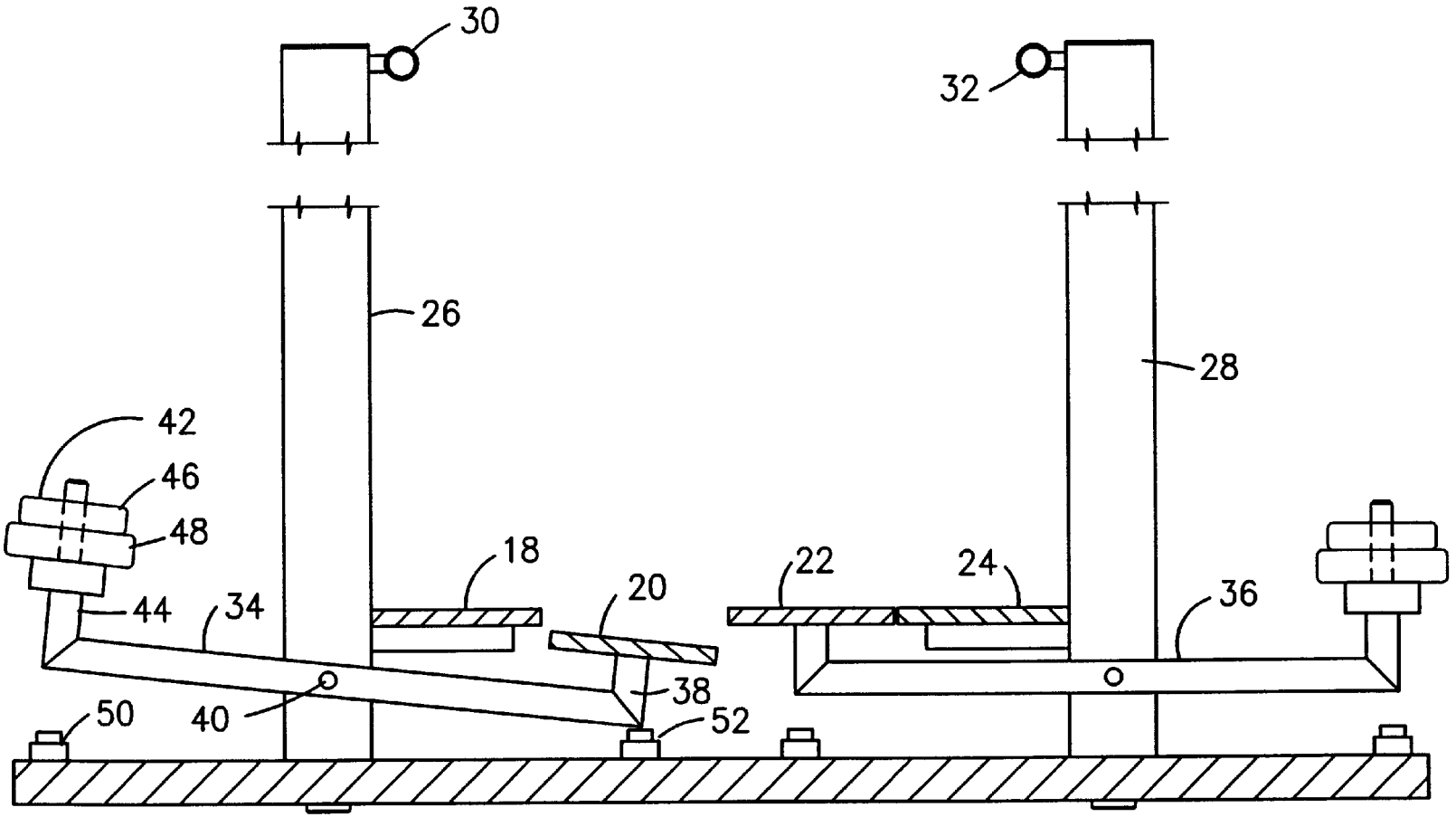
FIG. 2 is a cross sectional view taken transversely through the rehabilitation apparatus depicting conceptionally the principles of the present invention in regard to a first embodiment, and illustrating the moving elements in two positions.

As illustrated in FIG. 2, the platforms 18 and 24 are fixed platforms secured to a plurality of upstanding rails 26, 28 respectively on corresponding sides of the walkway, the rails 26, 28 having a respective handrail 30, 32 extending longitudinally secured thereto above the platforms as best illustrated in FIG. 1. Each of the platforms 20, 22 is a movable platform being carried by a structure including a plurality of respective levers 34, 36 pivotally journaled on the rails 26, 28 at the respective side in the vicinity of the platforms. Each lever 34, 36 and the movable platfonn driving system is identical and reference to that associated with the platform 20 and its lever 34 only will be described.

The movable platform 20 may be secured to a driver including an upstanding support arm 38 spaced from the journal or pivot bearing 40, while a weight mass or stack of weights 42 may be mounted on a second upstanding arm 44 spaced from the journal 40 and from the platform 20. The weight mass or stack 42 is adjustable by adding or subtracting weights 46, 48. The greater the amount of weight on the stack 42 the greater the movement placed on the lever and thus the greater the upward force placed on the platform 20. The upward movement of the platform 20 is limited by a limit block 50 while the downward movement is limited by another limit block 52. Thus, a patient may stride on the platforms 18 and 20, with a foot on each holding the handrail 30 and the force on the leg which is on the platform 20 may be controlled. If the patient has a weight bearing restriction on the leg which is on the platform 20, the weight stack 42 can be selected to apply the maximum force equal to that of the weight restraint onto the platform 20 and thus the leg thereon. The force applied will, of course, depend upon the weight in the stack and the length of each leg of the lever from the journal. This, however, is simple mechanics and need not be further explained. Then if the patient applies more weight to the leg on the movable platform 20, the platform will begin to descend and thereby remind the patient to apply less weight or force.

A patient with a weight bearing restriction on both legs may stride on the two movable platforms 20 and 22, holding both handrails 30, 32, the weight stack associated with each being selected according to the weight restriction on each leg.

Figure 3:
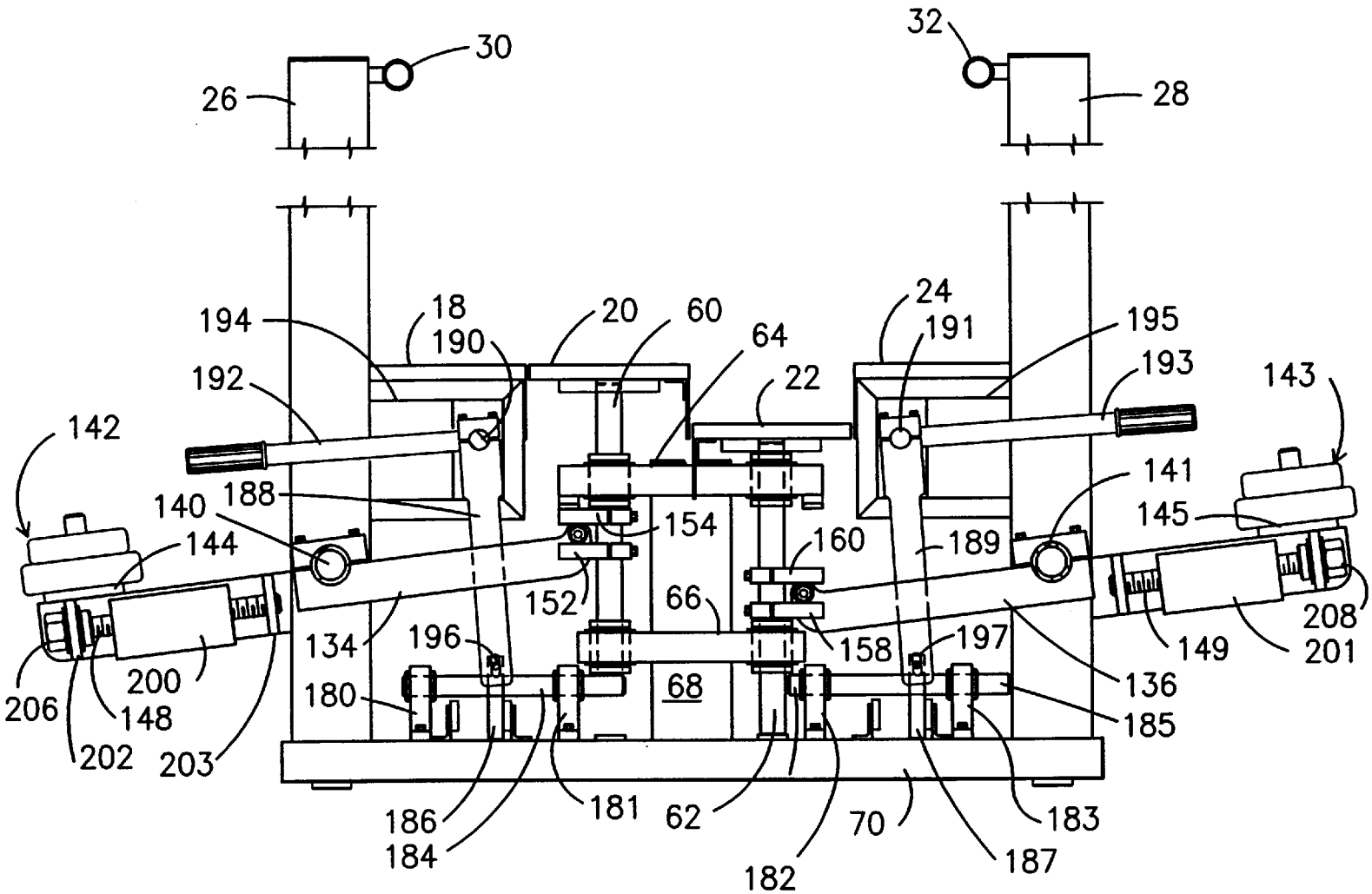
FIG. 3 is a view similar to FIG. 2, but taken transversely through the apparatus of FIG. 1 illustrating the preferred form of the present invention.
Figure 4:
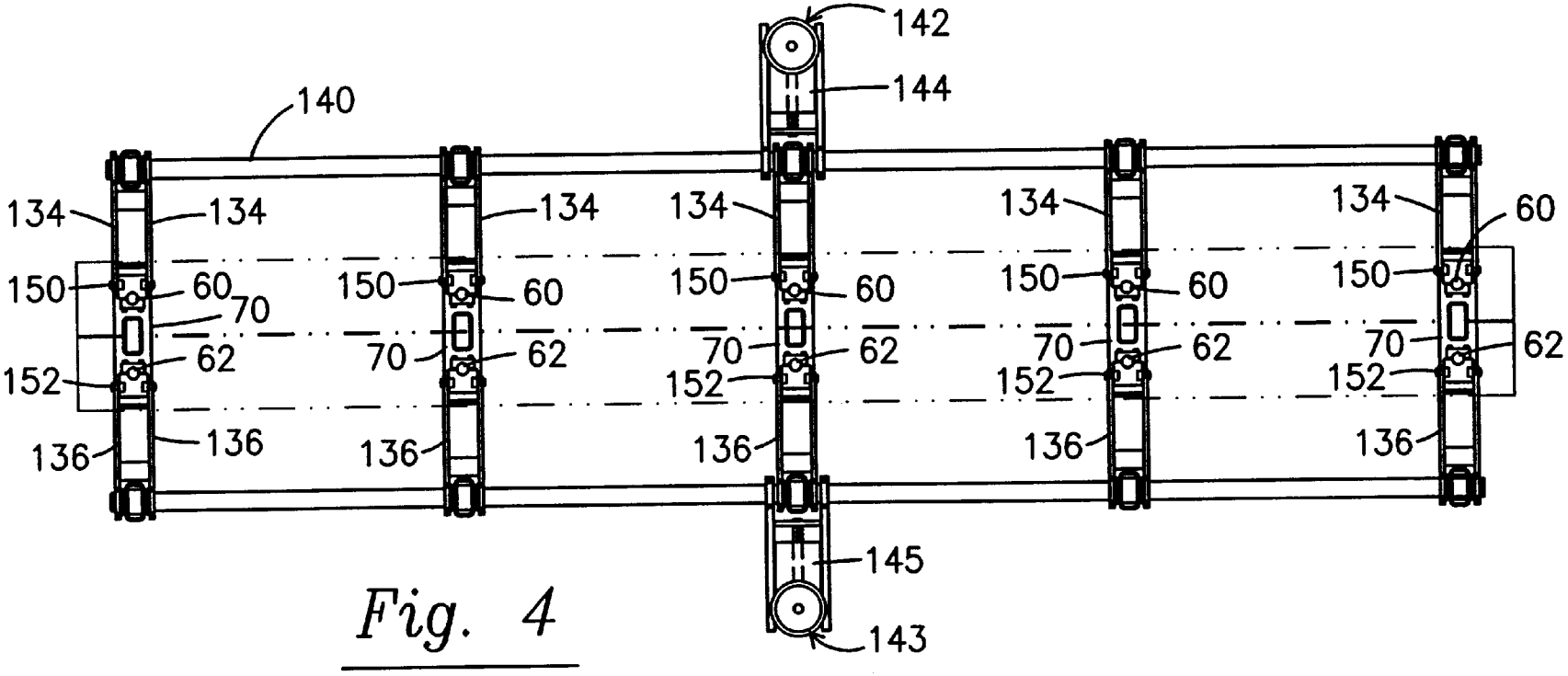
FIG. 4 is a top plan view of the apparatus illustrated in FIG. 1, with parts thereof removed to illustrate the platform moving mechanism.

One of the limitations of the single embodiment of the invention illustrated in FIG. 2 is that the movable platforms 20, 22 while moving vertically do not move in a vertical plane, i.e., they move in an arc. Thus, the preferred embodiment of the invention, which is illustrated in regard to FIGS. 3 through 5, overcomes this shortcoming. Thus, as illustrated in regard to these figures, the movable platforms 20 and 22 are secured to respective rods 60, 62, both rods being constrained to move in a vertical plane by guide housings 64, 66 carried by upstanding posts 68 intermediate the rod 60, 62 supported on cross members 70 forming part of the frame of the apparatus. The guide housings 64, 66 each mount linear bearings in which the rods 60, 62 travel in a vertical plane. As illustrated in FIG. 4, there may be five such pairs of rods 60, 62 for a walkway having platforms of approximately 12 to 15 feet. Moreover, there are a plurality of levers 134 and 136, preferably two corresponding to each rod 60 and 62, one on each side of a rail, respectively mounted on journal shafts 140, 141 extending longitudinally at each respective side. A weight stack 142, 143 is mounted about a spindle secured to a block 144, 145 attached to a plate 146, 147 through which an adjustment member such as the heads 206,208 of threaded rods 148,149, the threaded rods 148,149 being threadedly received in blocks 200,201 and spaced plates 202,203 so that when the heads 206,208 are rotated, the respective weight stack 142, 143 move toward and away from the respective journal shaft 140, 141 to change the moment applied by the levers 134, 136. Each lever carries a respective follower 150, 152 in the form of a small cylindrical rod which is trapped between a pair of U-shaped members 154, 156, 158, 160 secured to the rods 60, 62 respectively so that as the levers on one side move upwardly, the rods on that side do also, thereby moving or applying an upward force on the corresponding platforms, and vice versa when the platforms and the followers move downwardly.

Figure 5:
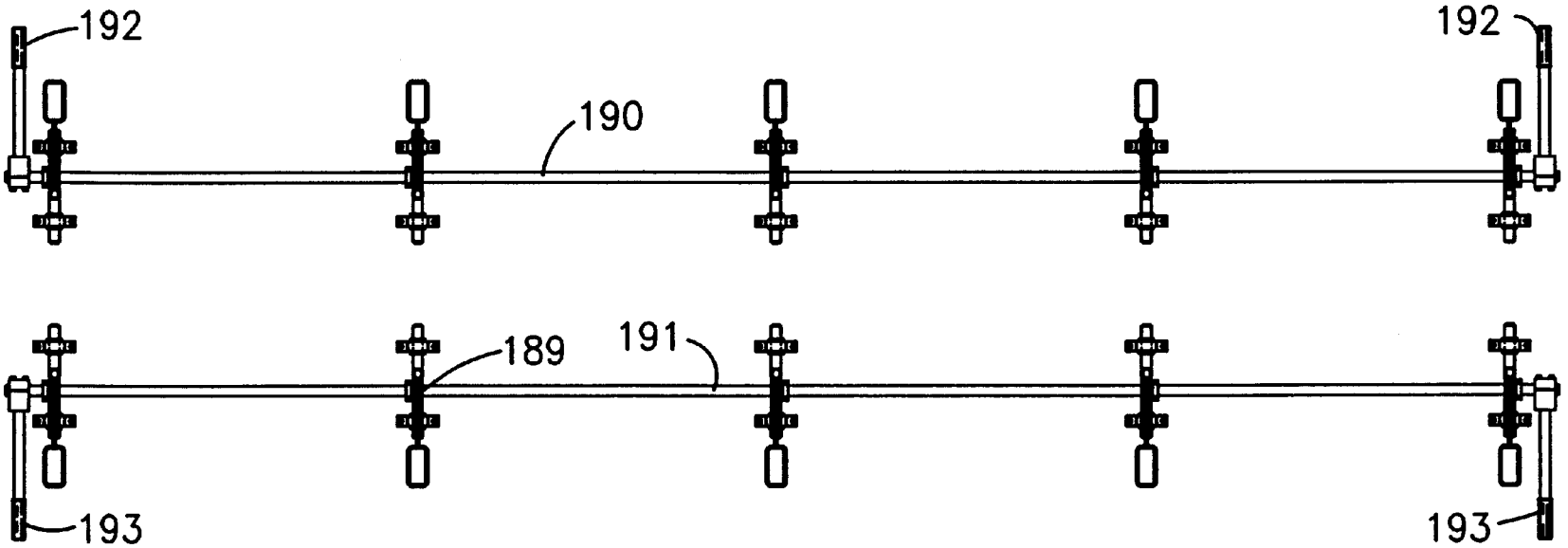
FIG. 5 is a view similar to FIG. 4, but with parts removed to illustrate the platform locking mechanism.

Disposed beneath each guide housing 66 in a pair of spaced bearing blocks 180, 181, and 182, 183 is a pair of spaced apart stop members 184, 185 in the form of rods which may move transversely within linear bearings in the bearing blocks. A plate 186, 187 is fastened to the respective stop member 184, 185, the plate carrying a pin 196, 197 respectively. Each pin 196, 197 is located within a slot in a respective arm 188, 189, there being five such arms on each side of the apparatus as illustrated in FIG. 5. Extending through all of the arms 188 is a shaft 190 while a similar shaft 191 extends through all the arms 189 spaced from the respective plates 186, 187. At each end of the walkway a manually graspable arm 192, 193 is secured at a respective side to the shaft 190, 191. Each arm 188, 189 is mounted below the fixed platforms 18, 24 in a respective housing 194, 195 having a slot in a lower wall so that the levers 188 and 189 may be moved transversely as the respective arm 192, 193 is raised or lowered. As this occurs, the lower end of the respective lever slides the respective pins 196 or 197 and thus the respective stop member 184, 185 transversely. When the stop member is moved from out of the path with the respective rod 60, 62, the movable platform may be moved vertically as illustrated in the right side of FIG. 3. When the stop member is moved under the path of the respective rod 60, 62 as illustrated in the left side of FIG. 3, the moveable platform associated therewith is locked in the up position. The operation of the apparatus is the same as described in regard to the structure in FIG. 2. However, the locking apparatus locking the movable platform in the upper position permits a starting condition when a patient is to walk on a fixed and a movable platform. The weights and moments are adjusted and the platform may then be unlocked, and the operation thereafter is the same as heretofore described in regard to FIG. 2.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A rehabilitation device comprising: a first vertically movable horizontally elongated stepping platform having a first substantially horizontal surface portion, a lever pivotably mounted about a journal coupled to said first stepping platform at a location spaced from said journal, a weight mass connected to said lever at a location spaced from said journal and from said first stepping platform, a first elongated stable platform adjacent to said first stepping platform having a second substantially horizontal surface portion located substantially parallel to the plane of the first substantially horizontal surface portion of the first stepping platform, said weight mass being chosen to locate said first stepping platform at an elevation relative to said second substantially horizontal surface such that a person may stride with a foot on each of the first stepping platform and the first stable platform while on said device and depress said first substantially horizontal surface downwardly relative to the first stable platform when a force on said first surface exceeds a predetermined amount.

2. A rehabilitation device as recited in claim 1, further comprising at least one handrail located at a predetermined distance above the first stable platform.

3. A rehabilitation device as recited in claim 1 further comprising a pair of substantially parallel handrails located at a predetermined distance above said first stable platform, said pair of handrails having a first and second handrail, each of said first and second handrails located adjacent to said first stepping platform.

4. A rehabilitation device as recited in claim 3 wherein said first surface portion has a first side, a second side, a top and a bottom, the first handrail of said pair of substantially parallel handrails is located at said first side of at least a portion of the first surface portion and the second handrail of said pair of substantially parallel handrails is located at said second side of at least a portion of the first surface portion.

5. A rehabilitation device as recited in claim 1 wherein said first substantially horizontal surface portion is moved linearly in a vertical plane between said first and second elevations.

6. A rehabilitation device as recited in claim 1 wherein the distance of said weight mass may be adjusted relative to said journal.

7. A rehabilitation device as recited in claim 1 further comprising a guide housing, and wherein said first stepping platform includes a guide rod secured to and movable with said stepping platform, and the guide housing constrains said guide rod for linear movement in a vertical plane.

8. A rehabilitation device as recited in claim 7, further comprising a coupling for connecting said lever to said guide rod.

9. A rehabilitation device as recited in claim 8, wherein said coupling comprises a follower member carried by said lever, and members on said rod capturing said follower.

10. A rehabilitation device as recited in claim 1 wherein said first and second horizontal surface portions have sufficient lengths permitting a person to make a number of strides with one foot on each platform.

11. A rehabilitation device as recited in claim 1 wherein the weight mass is selected based on the magnitude of a known force; and when said known force is greater than the force from the weight mass, said stepping platform begins to move downwardly.

12. A rehabilitation device as recited in claim 1 includes a second stepping platform and a second stable platform, said stepping platforms being intermediate said stable platforms.

13. A rehabilitation device comprising: a first vertically movable horizontally elongated stepping platform having a first substantially horizontal surface portion vertically moveable between first and second elevations, said first elevation being higher than said second elevation, a first weight carrying device connected to said first stepping platform and carrying a first weight for positioning said first stepping platform at said first elevation when there is no applied force acting on said first stepping platform, wherein when a force in excess of a first preselected amount is applied to said first stepping platform said first stepping platform moves between the first and second elevations, a second vertically movable horizontally elongated stepping platform having a second substantially horizontal surface portion vertically moveable between third and fourth elevations, said third elevation being higher than said fourth elevation, a second weight carrying device connected to said second stepping platform and carrying a second weight for positioning said second stepping platform at said third elevation when there is no applied force acting on said second stepping platform, wherein when a force in excess of a second preselected amount is applied to said second stepping platform said second platform moves between the third and fourth elevations, said first and second platforms being disposed side by side.

14. A rehabilitation device as recited in claim 13 further comprising at least one elongated stable platform mounted on said frame having a third substantially horizontal surface portion located substantially parallel to the plane of said first substantially horizontal surface portion of the first stepping platform, said at least one stable platform having an elevation substantially equal to said first elevation.

15. A rehabilitation device as recited in claim 13, including a pair of substantially parallel handrails, one handrail being disposed adjacent to the first stepping platform and a second handrail being disposed adjacent the second stepping platform.

16. A rehabilitation device as recited in claim 13, including a first lever pivotably mounted about a journal and coupled to said first stepping platform at a location spaced from said journal, said first weight carrying device being connected to said first lever at a location spaced from said journal, and a second lever pivotably mounted about a second journal and coupled to said second stepping platform at a location spaced from said second journal, and said second weight carrying device being connected to said second lever at a location spaced from said second journal.

17. A rehabilitation device as recited in claim 16, wherein said first substantially horizontal surface portion is moved linearly in parallel planes between said first and second elevation.

18. A rehabilitation device as recited in claim 16, further comprising at least two guide housings and wherein each of the first and second stepping platforms include a first and second guide rod, respectively, each of said first and second guide rods secured to and movable with the respective stepping platform, and the guide housings constrain each of the guide rods for movement linearly in a vertical plane.

19. A rehabilitation device as recited in claim 18, wherein the first and second levers are each coupled through first and second couplings to the first and second guide rods, respectively.

20. A rehabilitation device as recited in claim 19, wherein each of the first and second couplings include a follower member carrier by each of the first and second levers respectively, and a first and second cooperating member on each of the first and second guide rods respectively, capturing the follower member.

21. A rehabilitation device comprising: a first vertically movable horizontally elongated stepping platform having a first substantially horizontal surface portion vertically moveable between first and second elevations, a lever coupled to the first stepping platform, means for pivotably mounting said lever about a journal, a weight mass connected to said lever at a location spaced from said journal and from said first stepping platform, an elongated stable platform adjacent to said first stepping platform having a second substantially horizontal surface portion located substantially parallel to the plane of said first substantially horizontal surface portion of the first stepping platform, said weight mass locating said first stepping platform at an elevation relative to said second substantially horizontal surface, wherein when a force which is greater than a preselected force is applied to said first surface, said first surface moves downwardly.

22. A rehabilitation device as recited in claim 21, wherein said device includes means for moving said first substantially horizontal surface portion in a vertical plane only.

* * * * *